US006063252A

United States Patent [19]

Raymond

[11] Patent Number: 6,063,252

[45] Date of Patent: May 16, 2000

[54] METHOD AND APPARATUS FOR ENRICHING THE CHROMIUM IN A CHROMIUM PLATING BATH

[76] Inventor: John L. Raymond, 222 Sunnieholme Dr., Fairfield, Conn. 06430

[21] Appl. No.: 09/130,856

[22] Filed: Aug. 7, 1998

Related U.S. Application Data

[60] Provisional application No. 60/055,223, Aug. 8, 1997.

[51] Int. Cl.[7] ..... C25D 21/18

[52] U.S. Cl. ..... 205/99; 204/237; 204/DIG. 13; 205/101

[58] Field of Search ..... 205/99, 101, 284, 205/486; 204/237, 238, 239, DIG. 13

[56] References Cited

U.S. PATENT DOCUMENTS

| | | | |
|---|---|---|---|
| 1,851,603 | 3/1932 | Thomas | 205/101 |
| 2,081,787 | 5/1937 | Boss | 205/353 |
| 3,305,463 | 2/1967 | Carlin | 205/483 |
| 3,423,300 | 1/1969 | Joo et al. | 205/483 |
| 3,450,623 | 6/1969 | Joo et al. | 204/256 |
| 3,481,851 | 12/1969 | Lancy | 205/436 |
| 3,616,304 | 10/1971 | Bedi et al. | 205/170 |
| 3,682,796 | 8/1972 | Bedi et al. | 205/484 |
| 3,761,369 | 9/1973 | Tirrell | 205/750 |
| 3,948,738 | 4/1976 | Fujii | 205/99 |
| 3,983,016 | 9/1976 | Ellsworth et al. | 205/345 |
| 4,118,295 | 10/1978 | Korenowski et al. | 216/93 |
| 4,144,145 | 3/1979 | Watanabe et al. | 423/54 |
| 4,243,501 | 1/1981 | Wright, Jr. | 205/487 |
| 4,273,628 | 6/1981 | Kidon et al. | 205/482 |
| 4,290,864 | 9/1981 | Shuster et al. | 205/482 |
| 4,302,304 | 11/1981 | Ueda et al. | 205/770 |
| 4,326,935 | 4/1982 | Moeglich | 204/518 |
| 4,337,129 | 6/1982 | Soboroff et al. | 205/747 |
| 4,384,937 | 5/1983 | Shuster et al. | 204/237 |
| 4,948,476 | 8/1990 | Kamperman et al. | 205/483 |
| 5,051,155 | 9/1991 | Klotz et al. | 205/483 |
| 5,068,015 | 11/1991 | Block et al. | 205/486 |
| 5,071,522 | 12/1991 | Klotz et al. | 205/486 |
| 5,094,729 | 3/1992 | Klotz et al. | 205/485 |
| 5,096,547 | 3/1992 | Klotz et al. | 205/344 |
| 5,096,548 | 3/1992 | Lönhoff et al. | 205/572 |
| 5,112,583 | 5/1992 | Bruzzone et al. | 423/55 |
| 5,122,238 | 6/1992 | Morgan et al. | 205/486 |
| 5,127,999 | 7/1992 | Klotz et al. | 205/486 |
| 5,181,994 | 1/1993 | Lönhoff et al. | 205/486 |
| 5,405,507 | 4/1995 | Bishara et al. | 205/345 |

OTHER PUBLICATIONS

Chemistry & Theory of Chromium Deposition: Part I—Chemistry by N. V. Mandich, *Plating & Surface Finishing*, May 1997, pp. 108–115.

Chemistry & Theory of Chromium Deposition: Part II—Theory of Deposition by N. V. Mandich, *Plating & Surface Finishing*, Jun. 1997, 97–101.

*Porous Pot Operating Instructions* by Hard Chrome Plating Consultants, Inc.(3pp) Porous Pot Diagram by Gilbert & Jones, Inc. (1p) date not available.

*Primary Examiner*—Kathryn Gorgos
*Assistant Examiner*—William T. Leader
*Attorney, Agent, or Firm*—Ware, Fressola, Van Der Sluys & Adolphson LLP

[57] ABSTRACT

A method and apparatus for enriching the chromium concentration in an operating chrome plating from a spent chrome plating solution containing hexavalent chromium, trivalent chromium and extraneous metal ions is dislosed. A spent platining solution vessel is divided into an anode chamber and a cathode chamber by a porous container. A hollow primary anode is provided in the anode chamber and a plurality of cathodes are provided in the cathode chamber. A circularly shaped secondary anode is provided in the cathode chamber surrounding the cathodes and porous container. The primary anode and cathodes are connected to a primary electric circuit and the secondary anode and the cathodes are connected to a secondary electric. Operating solution from an operating plating vessel containing hexavalent chromium at a pre-enriched concentration is pumped to the anode compartment and hexavalent chromium enriched anolyte is flowed from the anode compartment to the operating plating vessel. The spent plating solution is the source of hexavalent chromium that enriches the solution in the anode compartment.

7 Claims, 2 Drawing Sheets

METHOD AND APPARATUS FOR ENRICHING THE CHROMIUM IN A CHROMIUM PLATING BATH

This application claims the benefit of U.S. Provisional application Ser. No. 60/055,223 filed Aug. 8, 1997.

BACKGROUND OF THE INVENTION

1. Field of the Invention

The present invention relates to a method and apparatus for enriching the hexavalent chromium in a chromium plating bath. More particularly, the present invention relates to a method and apparatus for enriching the hexavalent chromium content in an operating chrome plating solution with chromium from a spent chromium plating solution.

2. Description of the Prior Art

Typical chromic acid baths are used to electroplate chrome on various surfaces. The baths contain hexavalent chromium. When chromium metal is deposited from the typical solution of chromium acid (e.g., 2.5M chromic acid and 0.025M sulfuric acid, the reduction reaction at the cathode is less than 25 percent efficient. The principal by-product of the process is hydrogen, but some trivalent chromium and other cations are also generated from the reduction.

Over a period of time during operation of such baths, the buildup of trivalent chromium and certain other cations is deleterious to the chromium plating bath. Among the problems caused by the trivalent chromium and other cations are: reduced throwing power which is defined as the ability to initiate plating over an irregular surface; reduced bath conductivity which increases the voltage required and power costs; and changed plate distribution which means that a complex rack designed to produce a uniformly plated surface with a fresh solution may no longer to do. Other deleterious cations typically encountered are iron, copper and aluminum. The effects of the individual cations are additive and some hard chromium platers will set a limit of 15 grams per liter for the total of all cations.

Soluble anodes commonly used to replenish the metal in other plating baths cannot be used in chromium plating as the chromium dissolves as the trivalent cation. Therefore, lead is used as an insoluble anode and it has been found that not as much trivalent would be produced as might be expected or that some of the trivalent was being oxidized back to the hexavalent cation at the lead anode. Platinum and other insoluble anodes do not produce this effect and a great deal of trivalent chromium is produced. It has been found that for trivalent to be oxidized to hexavalent, the lead must be covered with a film of lead oxides and that the oxides are the actual reducing agent. During electrolysis, the lead oxide is constantly being reformed as soon as it is reduced. When a lead anode is first put in service it must be electrolyzed until a film of lead oxide is formed. (Conveniently, the lead oxide film is an unmistakable chocolate brown to almost black color.)

It is recommended that the ratio of the area of the anode to the area of the work being plated be at least 2:1 to avoid build-up of trivalent chromium in the bath. Unfortunately, particularly in chromium plating applied for engineering design reasons as opposed to decorative plating applied for aesthetic reasons, this is frequently not possible and the amount of trivalent chromium in the tank builds up until the bath becomes unusable.

Historically, one of the methods to solve the problem of excessive trivalent (or cationic) contamination was to decant and discard a portion of the solution which is prohibitively expensive today. An environmentally acceptable traditional method was the practice of "dummying" the tank. A procedure where a small cathode was plated with a very large anode area which oxidized more trivalent at the anode than was formed at the cathode. This will reduce the trivalent level, albeit slowly and with a relatively high power cost.

The use of a porous pot surrounding the cathode was developed prior to World War II. The pot confined the trivalent formed more or less to the volume of solution within the pot and it did not mix with the body of the solution which increased the efficacy of the process in comparison with plain dummying. The use of the porous pot dummying is widespread and is typified by the Peger cell. The ceramic pot used by Peger and others is an unglazed ceramic that will withstand the plating solution. The pore size varies but if filled with water, it will weep slowly and is retentive enough for plating solutions that they can be pumped out without excessive influx or can even be physically emptied. However, the pot is not a semi-permeable membrane and back migration of the ions will occur when power is turned off. It is important to empty the contaminated solution within the pot when turning the power off.

In the Peger pot, the cathode is inside the pot and it is claimed that migration of the trivalent into the pot takes place. However, this may be misleading, for while some migration will take place as cations do move towards the cathode, much more than 95 percent of the trivalent inside the pot is caused by the reduction of the solution in the pot. The green color described in the pot is trivalent chromium. Most of the reduction in trivalent that is obtained with the pot is by oxidation on the surface of the lead anodes outside the pot.

In summary, porous ceramic pots are a reasonably efficient device for reducing the level of trivalent chromium in a plating bath, however, the use of this device does not increase the hexavalent chromium concentration in an operating solution, it merely reduces the level of trivalent chromium.

There are a number of patents discussing electrodialysis using a perfluorosulfonic acid cation exchange membrane separating the anolyte from the catholyte. These are effective in oxidizing trivalent chromium and will remove iron and copper from the chromium plating bath. However, the efficiency is poor.

It is desirable to provide a method and apparatus which enriches the hexavalent chromium concentration in an operating chrome plating solution with chromium from a spent chrome plating solution without decanting and discarding a portion of the operating solution. Such method and apparatus is particularly desirable because it reduces the cost of plating, the cost of disposal and is more environmentally friendly.

SUMMARY OF THE INVENTION

It is an object of the present invention to provide a method and apparatus for enriching an operating chrome plating solution with chromium from a spent chrome plating solution containing hexavalent chromium, trivalent chromium and extraneous metal ions.

The object of the present invention is accomplished, at least in part, by the apparatus of the present invention, which is an apparatus for enriching an operating chrome plating solution with hexavalent chromium from a spent chrome plating solution containing hexavalent chromium, trivalent chromium and extraneous metal ions. More specifically, the apparatus comprises an operating plating vessel for containing an operating chrome plating solution comprising sulfuric acid catalyzed hexavalent chromium and a spent plating solution vessel for containing a spent chrome plating solution, the spent solution comprising a mixture of hexavalent chromium, trivalent chromium and extraneous metal ions. The spent plating solution vessel has a porous container disposed therein dividing the spent solution vessel into a cathode compartment surrounding the porous container and an anode compartment within the porous container. The porous container has a suitable porosity for permitting substantial ionic migration between the anode compartment and the cathode compartment while at the same time preventing anolyte and catholyte mixing. A hollow primary anode is disposed within the porous container. A plurality of cathodes are disposed in the cathode compartment of the spent solution vessel and a circularly shaped secondary anode is disposed in the cathode compartment around the plurality of cathodes. The apparatus is provided with two conduits for flowing operating plating solution containing hexavalent chromium at a pre-enriched concentration from the operating plating vessel into the anode compartment through the interior of the hollow primary anode and for flowing enriched plating solution containing hexavalent chromium at an enriched concentration, higher than the pre-enriched concentration, from the anolyte compartment into the operating plating vessel. To enrich the hexavalent chromium concentration in the anolyte, the apparatus is provided with a primary electric circuit connected between the hollow primary anode and the plurality of cathodes. The primary electric circuit is operated to provide a primary electric potential and current density sufficient to promote oxidation of trivalent chromium to hexavalent chromium in the anolyte compartment and to also promote migration of chromium ions through the porous container into the anode compartment. The apparatus is also provided with a secondary electric circuit connected between the circular secondary anode and the plurality of cathodes. The secondary electric circuit is operated so as to provide a secondary electric potential and current density sufficient to promote oxidation of trivalent chromium to hexavalent chromium in the catholyte compartment.

Other objects and advantages of the present invention will become apparent and the invention will be more fully understood when reference is made to the following detailed description taken in conjunction with the accompanying drawings.

BRIEF DESCRIPTION OF THE DRAWINGS

The drawings, not drawn to scale, include.

DETAILED DESCRIPTION OF THE PRESENT INVENTION

Figure 1:
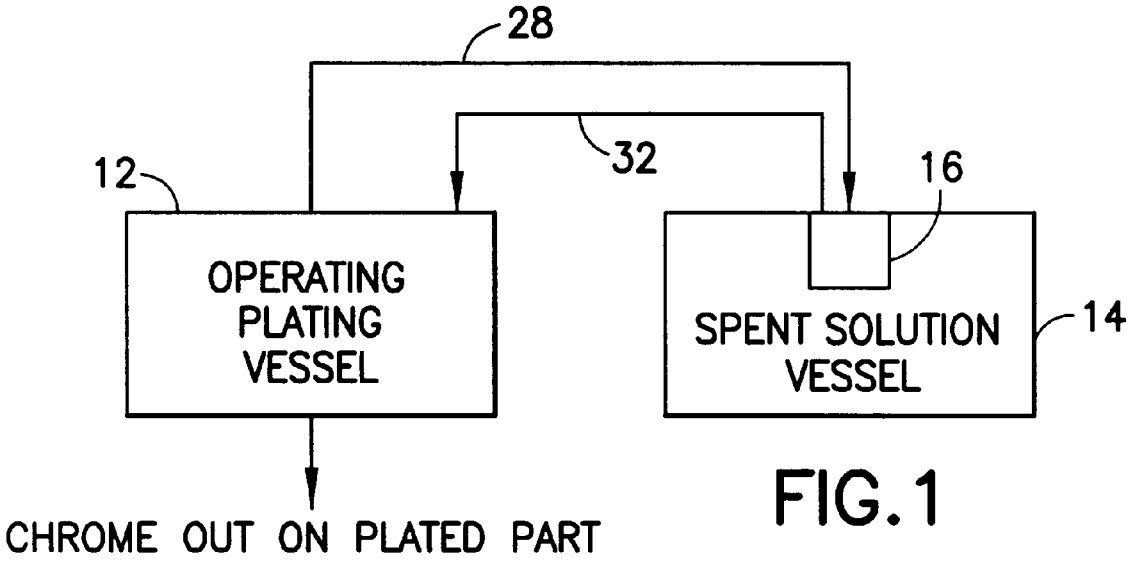
FIG. 1, which is a general schematic illustration of the method of the present invention.
Figure 2:
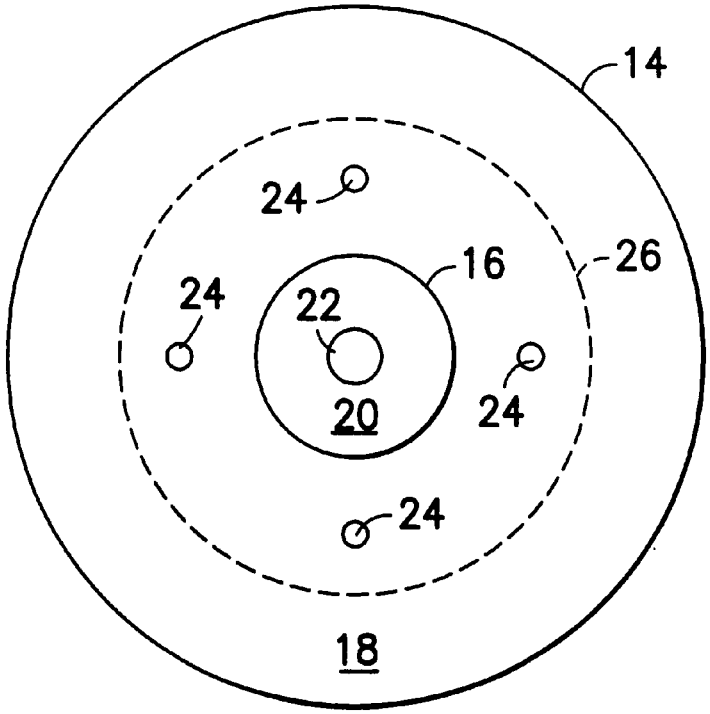
FIG. 2, which is a top view schematic illustration of the spent solution vessel used in the present invention.
Figure 3:
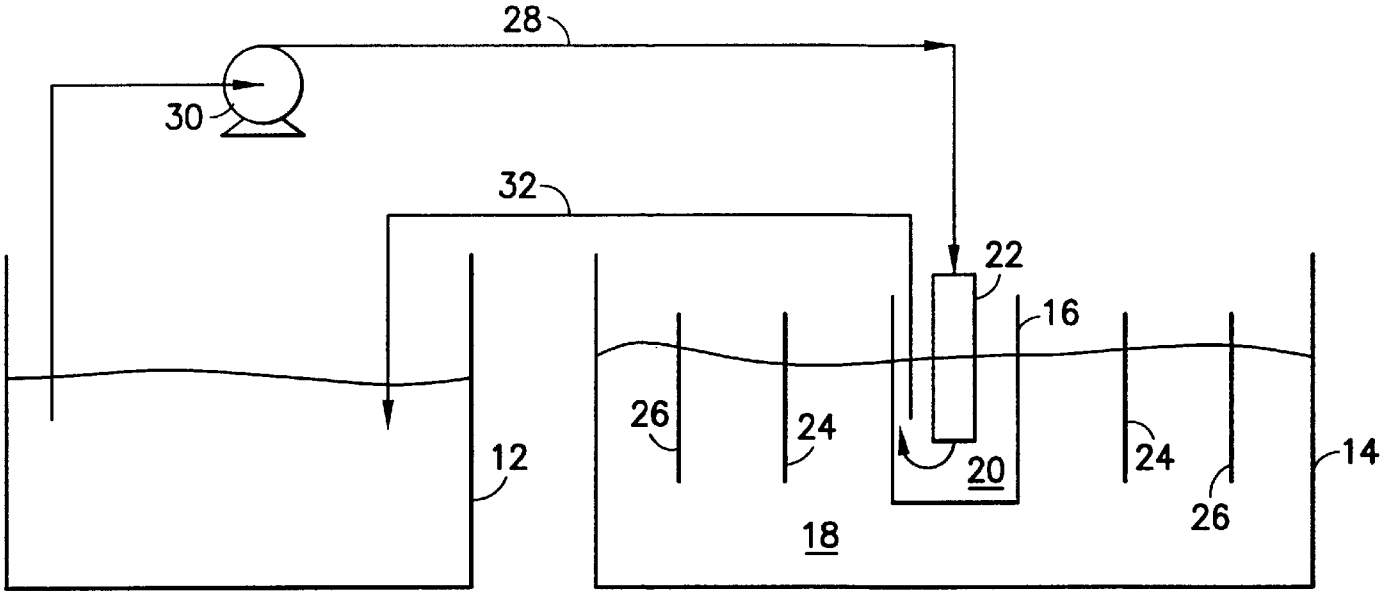
FIG. 3, which is a schematic illustration of the apparatus for carrying out the method of the present invention.

The present invention is directed to enriching an operating chrome plating solution with chromium from a spent chrome plating solution containing hexavalent chromium, trivalent chromium and extraneous metal ions. The method is carried out on the apparatus illustrated in the Figures.

Referring to the Figures, the apparatus 10 includes two vessels: an operating plating vessel 12 for containing operating chrome plating solution comprising sulfuric acid catalyzed hexavalent chromium; and a spent plating solution vessel 14 for containing spent chrome plating solution comprising a mixture of hexavalent chromium, trivalent chromium and extraneous metal ions. Typically, the concentration of trivalent chromium in the spent chrome plating solution is about 15 grams per liter. A porous container 16 is disposed in the spent plating solution vessel 14. The porous container 16 is disposed so as to divide the spent solution vessel 14 into a cathode compartment 18 surrounding the porous container 16 and an anode compartment 20 within the porous container 16. The porous container 16 is made to have a suitable porosity for permitting substantial ionic migration between the anode compartment 20 and the cathode compartment 18 while at the same time preventing anolyte and catholyte mixing. Preferably, the porous container 16 is made from ceramic materials and is cylindrically shaped.

A hollow primary anode 22 is disposed within the porous container 16. The surface of the primary anode is preferably coated with lead. A plurality of cathodes 24 are disposed in the cathode compartment 18 of the spent solution vessel. A circularly shaped secondary anode 26 is disposed in the cathode compartment 18 around the plurality of cathodes 24. The secondary electrode is preferably made from a perforated lead sheet which encircles the cathodes.

A feed conduit 28 is connected between the operating plating vessel 12 and the primary hollow anode 22. Operating plating solution containing hexavalent chromium at a pre-enriched concentration, as well as some trivalent chromium, is flowed from the operating plating vessel into the anode compartment 20 through the interior of the hollow primary anode 22. A pump 30 may be utilized to pump the operating plating solution through the conduit 28. The apparatus is also provided with a return conduit 32 connected between the anolyte compartment 20 and the operating plating vessel 12. Enriched plating solution containing hexavalent chromium at an enriched concentration, higher than the pre-enriched concentration level, is returned to the operating plating vessel 12 through the return conduit 32. The flow in the return conduit 32 from the anolyte compartment 20 to the operating plating vessel 12 may be pump driven or gravity driven, as desired.

Figure 4:
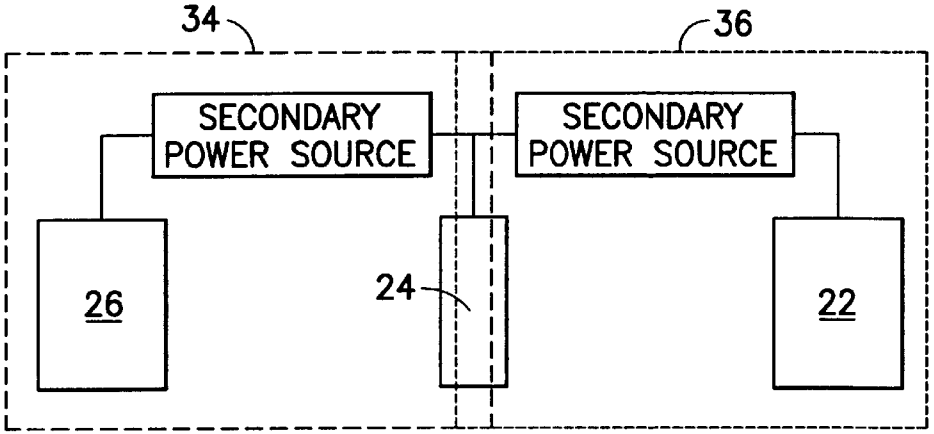
FIG. 4, which is a schematic illustration of the electric circuits used in the present invention.

Referring to FIG. 4, the apparatus is further provided with a primary electric circuit 34 connected between the hollow primary anode 22 and the plurality of cathodes 24. The primary electric circuit 34 provides a primary electric potential and current density sufficient to promote the oxidation of trivalent chromium to hexavalent chromium in the anolyte compartment 20 and also to promote migration of chromium ions from the cathode compartment to the anode compartment through the porous container. Typically, the electropotential is on the order of about 8.5 volts and the current is on the order of about 1200 amps. A secondary electric circuit 36 is connected between the circularly shaped secondary anode 26 and the plurality of cathodes 24. The secondary electric circuit 36 provides an electropotential and current density sufficient to promote the oxidation of trivalent chromium to hexavalent chromium in the catholyte compartment 18. This secondary electric circuit, and the electropotential and current density resulting therefrom, is also believed to play a role in keeping the electropotential in the first circuit in the range is useful for oxidizing trivalent chromium and for promoting migration of chromium ions into the anode compartment. The typical voltage in the second circuit is about half of the voltage, on the order of 4.5 volts, of the primary circuit and the current is on the order of about 1200 amps. This lesser voltage is primarily the lack of an intermediate porous cell.

In the method, operating plating solution containing hexavalent chromium at a pre-enriched concentration level is flowed from the operating plating vessel 12 into the anode compartment 20 through the interior of the hollow primary anode 22. The operating plating solution typically contains both hexavalent chromium and trivalent chromium ions. It is believed that at least some of the trivalent chromium ions in the operating plating solution in the anode compartment are oxidized into hexavalent chromium ions by the current flowing in the primary electric circuit 34, thereby enriching the hexavalent chromium concentration in the anolyte compartment. Also, it is believed that trivalent chromium contained in the spent plating solution is oxidized into hexavalent chromium at the plurality of secondary anodes 26 in the cathode compartment by the current flowing in the secondary electric circuit 36. It is further believed that the primary electric circuit causes trivalent chromium contained in the spent solution to migrate from the cathode compartment 18 into the anode compartment 20 through the porous container 16, thereby further enriching the hexavalent chromium concentration in the anolyte compartment 20. Enriched plating solution containing hexavalent chromium at an enriched concentration, higher than the pre-enriched concentration of the operating plating solution, is returned to the operating plating vessel.

With the present invention, it was possible to run a precision plating tank that required a low level of total cationic contamination without any decanting. Prior to the present invention, the same precision plating required periodic decanting. Also, it is possible to utilize scrap or spent plating solution for the enrichment of hexavalent chromium in the anolyte compartment, sufficient to replenish that used in the deposition of chromium on the workpieces. Since substantially all of the cationic impurities stay in the catholyte, the increase in the hexavalent chromium concentration in the anolyte compartment is free of additional contaminants.

The embodiment of the present invention disclosed herein admirably achieves the objects set forth; however, it should be appreciated by those skilled in the art that departures can be made by those skilled in the art without departing from the spirit and scope of the invention which is limited only by the following claims.

What is claimed is:

1. An apparatus for enriching an operating chrome plating solution with hexavalent chromium from a spent chrome plating solution containing hexavalent chromium, trivalent chromium and extraneous metal ions, the apparatus comprising:

an operating plating vessel for containing an operating chrome plating solution comprising sulfuric acid catalyzed hexavalent chromium;

a spent plating solution vessel for containing a spent chrome plating solution, the spent solution comprising a mixture of hexavalent chromium, trivalent chromium and extraneous metal ions;

a porous container disposed in the spent plating solution vessel, the porous container dividing the spent solution vessel into a cathode compartment surrounding the porous container and an anode compartment within the porous container, the porous container having a suitable porosity for permitting substantial ionic migration between the anode compartment and the cathode compartment while at the same time preventing anolyte and catholyte mixing;

a hollow primary anode disposed within the porous container;

a plurality of cathodes disposed in the cathode compartment of the spent solution vessel;

a circularly shaped secondary anode disposed in the cathode compartment around the plurality of cathodes;

means for flowing operating plating solution containing hexavalent chromium at a pre-enriched concentration from the operating plating vessel into the anode compartment through the interior of the hollow primary anode;

means for flowing enriched plating solution containing hexavalent chromium at an enriched concentration, higher than the pre-enriched concentration, from the anolyte compartment into the operating plating vessel;

a primary electric circuit connected between the hollow primary anode and the plurality of cathodes for providing a primary electric potential and current density sufficient to promote oxidation of trivalent chromium to hexavalent chromium in the anolyte compartment and to also promote migration of chromium ions through the porous container into the anode compartment; and a secondary electric circuit connected between the secondary anode and the plurality of cathodes for providing a secondary electric potential and current density sufficient to promote oxidation of trivalent chromium to hexavalent chromium in the catholyte compartment.

2. The apparatus of claim 1, wherein the porous container is ceramic.

3. The apparatus of claim 2, wherein the porous container is cylindrical.

4. The apparatus of claim 1, wherein the surface of the hollow primary anode is coated with lead.

5. The apparatus of claim 1, wherein the secondary anode is made from lead.

6. The apparatus of claim 1, wherein the secondary anode is made from a perforated lead sheet.

7. A method for enriching a chrome plating solution with hexavalent chromium from a spent chrome plating solution containing hexavalent chromium, trivalent chromium and extraneous metal ions, the method comprising the steps of:

providing an operating plating vessel for containing an operating chrome plating solution comprising sulfuric acid catalyzed hexavalent chromium;

providing a spent plating solution vessel for containing a spent chrome plating solution comprising a mixture of hexavalent chromium, trivalent chromium and extraneous metal ions, the vessel further including:

a porous container in the spent plating solution vessel so as to divide the spent solution vessel into a cathode compartment surrounding the porous container and an anode compartment within the porous container, the porous container having a suitable porosity for permitting substantial ionic migration between the anode compartment and the cathode compartment while at the same time preventing anolyte and catholyte mixing;

a hollow primary anode disposed within the porous container;

a plurality of cathodes disposed in the cathode compartment;

a circularly shaped secondary anode disposed in the cathode compartment around the plurality of cathodes;

flowing operating plating solution containing hexavalent chromium at a pre-enriched concentration from the operating plating vessel into the anode compartment through the interior of the hollow primary anode;

flowing enriched plating solution containing hexavalent chromium at an enriched concentration, higher than the pre-enriched concentration, from the anolyte compartment into the operating plating vessel;

providing a primary electric potential and current density between the hollow primary anode and the plurality of cathodes sufficient to promote the oxidation of at least some of the trivalent chromium to hexavalent chromium in the anolyte compartment and to also promote migration of chromium ions through the porous container into the anode compartment; and providing a secondary electric potential and current density between the plurality of secondary anodes and the plurality of cathodes sufficient to promote the oxidation of at least some of the trivalent chromium to hexavalent chromium in the catholyte compartment.

* * * * *